US010054876B2

(12) United States Patent
Kashimoto

(10) Patent No.: US 10,054,876 B2
(45) Date of Patent: Aug. 21, 2018

(54) DEVELOPING DEVICE, IMAGE FORMING APPARATUS

(71) Applicant: KYOCERA Document Solutions Inc., Osaka-shi, Osaka (JP)

(72) Inventor: Masahiro Kashimoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 4 days.

(21) Appl. No.: 15/495,728

(22) Filed: Apr. 24, 2017

(65) Prior Publication Data

US 2017/0315474 A1 Nov. 2, 2017

(30) Foreign Application Priority Data

Apr. 27, 2016 (JP) ..... 2016-089883

(51) Int. Cl.
*G03G 15/08* (2006.01)
*G03G 21/12* (2006.01)
*G03G 21/10* (2006.01)

(52) U.S. Cl.
CPC ..... *G03G 15/0891* (2013.01); *G03G 15/0872* (2013.01); *G03G 21/12* (2013.01); *G03G 21/105* (2013.01); *G03G 2221/1657* (2013.01)

(58) Field of Classification Search
CPC ..... G03G 15/0893; G03G 15/0877; G03G 15/0865; G03G 15/0889
See application file for complete search history.

(56) References Cited

U.S. PATENT DOCUMENTS

2007/0048009 A1 3/2007 Izumi et al.
2008/0080901 A1* 4/2008 Ishiguro ..... G03G 15/0879 399/258
2011/0229184 A1* 9/2011 Kashimoto ..... G03G 15/0896 399/92
2014/0348543 A1* 11/2014 Kashimoto ..... G03G 15/0121 399/257

FOREIGN PATENT DOCUMENTS

JP 200794386 A 4/2007

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

A developing device develops, with developer, an electrostatic latent image formed on an image carrying member, and includes a developing tank, a developer carrying member, and a drive input portion. The developing tank stores the developer and has a receiving port and a discharge port through which the developer is received and discharged respectively. The developer carrying member rotates in the developing tank while carrying the developer. The drive input portion receives a rotational force from outside the developing device and transmit the rotational force to a driven rotation shaft that is a rotation shaft of the developer carrying member. The receiving port, the discharge port, and the drive input portion are provided in the developing tank to be close to an end of the developing tank in a longitudinal direction of the developing tank.

3 Claims, 7 Drawing Sheets

DEVELOPING DEVICE, IMAGE FORMING APPARATUS

INCORPORATION BY REFERENCE

This application is based upon and claims the benefit of priority from the corresponding Japanese Patent Application No. 2016-089883 filed on Apr. 27, 2016, the entire contents of which are incorporated herein by reference.

BACKGROUND

The present disclosure relates to a developing device and an image forming apparatus including the same.

A typical electrophotographic image forming apparatus includes a developing device and a developer replenishing unit. The developing device develops, by powdery developer, an electrostatic latent image formed on an image carrying member. The developer replenishing unit stores unused developer to be supplied to the developing device.

Furthermore, the image forming apparatus may include a developer collecting unit that stores used developer discharged from the developing device. The developer replenishing unit and the developer collecting unit are attached to an apparatus main body in a detachable manner.

It is noted that the developer replenishing unit may be referred to as a toner cartridge or a toner container. In addition, the developer collecting unit may be referred to as a waste toner box or a waste toner bottle.

The developing device includes rotators such as a developer carrying member and a stirring member that are driven by a motor provided in the apparatus main body. In addition, the motor and a drive input portion of the developing device are provided on a rear side (innermost side) in the main body portion so as to suppress transmission of machinery sounds to a user side, namely a front side of the main body portion. The drive input portion is a mechanism that receives a rotational force from the motor and transmits the received rotational force to rotation shafts of the rotators.

There is known a developing device in which a developer receiving port and a developer discharge port are provided in a front end portion of the device main body.

SUMMARY

A developing device according to an aspect of the present disclosure develops, with developer, an electrostatic latent image formed on an image carrying member, and includes a developing tank, a developer carrying member, and a drive input portion. The developing tank stores the developer and has a receiving port and a discharge port through which the developer is received and discharged respectively. The developer carrying member rotates in the developing tank while carrying the developer. The drive input portion receives a rotational force from outside the developing device and transmit the rotational force to a driven rotation shaft that is a rotation shaft of the developer carrying member. The receiving port, the discharge port, and the drive input portion are provided in the developing tank to be close to an end of the developing tank in a longitudinal direction of the developing tank.

An image forming apparatus according to another aspect of the present disclosure includes an image carrying member on whose surface an electrostatic latent image is formed, the developing device, a developer replenishing unit, a developer collecting unit, and a motor. The developing device develops the electrostatic latent image with developer. The developer replenishing unit is attached to an apparatus main body from a front side thereof in a detachable manner. The developer replenishing unit is formed to extend along a depth direction of the apparatus main body and stores developer to be replenished to the developing device. An opening that is communicated with the receiving port of the developing tank is formed, as a feed port through which the developer is fed, in an end portion of the developer replenishing unit that is inserted to be on a rear side of the apparatus main body. The developer collecting unit is attached to the apparatus main body from the front side thereof in a detachable manner. The developer collecting unit is formed to extend along the depth direction of the apparatus main body and stores developer discharged from the developing device. An opening that is communicated with the discharge port of the developing tank is formed, as a collection port through which the developer is collected, in an end portion of the developer collecting unit that is inserted to be on the rear side of the apparatus main body. The motor is provided on the rear side in the apparatus main body and generates the rotational force to be output to the drive input portion of the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
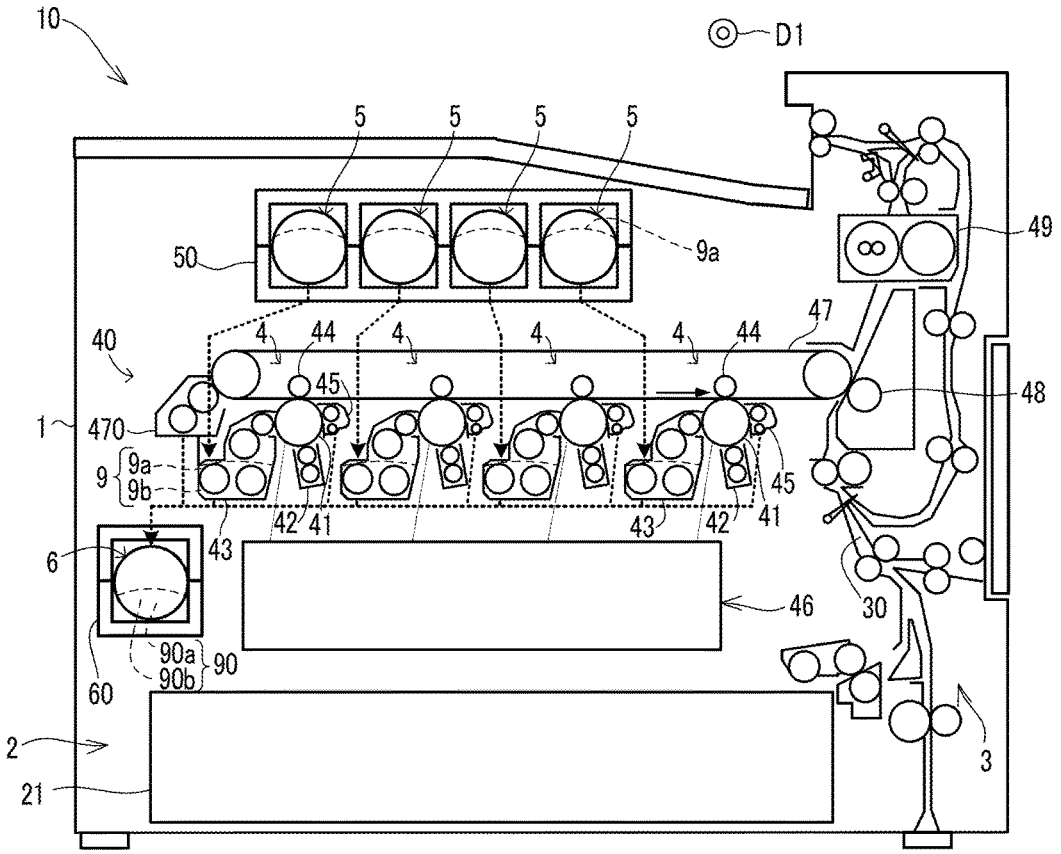
FIG. 1 is a configuration diagram of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure.

[Outlined Configuration of Image Forming Apparatus 10]

An image forming apparatus 10 according to the embodiment of the present disclosure forms an image with toner 9*a* on a sheet by an electrophotography method. The sheet is a sheet-like image formation medium such as a sheet of paper or an envelope.

The image forming apparatus 10 includes, in a main body portion 1, a sheet supply portion 2, a sheet conveying portion 3, an image forming portion 40, a laser scanning unit 46, a fixing device 49, a toner replenishing unit 5, and a developer collecting unit 6. It is noted that the main body portion 1 is the main body of the image forming apparatus 10.

In the following description, a direction heading from a front surface side of the main body portion 1 toward a rear surface side is referred to as a first direction D1, and a direction reverse to the first direction D1 is referred to as a second direction D2. A front surface and a rear surface of the main body portion 1 are end surfaces of the main body portion 1 that are respectively in the front side and innermost side in a depth direction D1-D2 of the main body portion 1.

The image forming portion 40 executes an image forming process of forming a toner image on the sheet. The image forming portion 40 executes the image forming process by using a two-component developer 9 that includes toner 9*a* and carrier 9*b*. The carrier 9*b* is a granular material having magnetism. It is noted that the two-component developer 9 including the toner 9*a* and the carrier 9*b* is an example of the developer.

Each of image forming units 4 includes a photoconductor 41, a charging device 42, a developing device 43, a primary transfer device 44, and a primary cleaning device 45.

The image forming apparatus 10 shown in FIG. 1 is a tandem-type image forming apparatus, and is a color printer. Accordingly, the image forming portion 40 includes a plurality of image generating units 4, a plurality of toner replenishing units 5, an intermediate transfer belt 47, a secondary transfer device 48, and a secondary cleaning device 470, wherein the plurality of image generating units 4 respectively correspond to a plurality of colors of toner 9*a*.

The sheet supply portion 2 feeds the sheet to a sheet conveyance path 30, and the sheet conveying portion 3 conveys the sheet along the sheet conveyance path 30.

The drum-like photoconductor 41 rotates and the charging device 42 charges the surface of the photoconductor 41. Furthermore, the laser scanning unit 46 writes an electrostatic latent image on the surface of the photoconductor 41 by scanning a laser beam thereon. The photoconductor 41 is an example of the image carrying member on whose surface the electrostatic latent image is formed.

Furthermore, the developing device 43 develops the electrostatic latent image with the toner 9*a* included in the two-component developer 9 and thereby forms a toner image. Subsequently, the primary transfer device 44 transfers the toner image from the surface of the photoconductor 41 to the intermediate transfer belt 47. The primary cleaning device 45 removes the toner 9*a* that has remained on the surface of the photoconductor 41.

The toner replenishing units 5 store unused toner 9*a* that is to be replenished to the developing device 43. The toner replenishing units 5 are attached to a replenishing unit attachment portion 50 of the main body portion 1 in a detachable manner. Each of the toner replenishing units 5 is replaced when it becomes empty of the toner 9*a*. Details of the toner replenishing units 5 are described below.

The secondary transfer device 48 transfers the toner image formed on the intermediate transfer belt 47, to the sheet. The secondary cleaning device 470 removes the toner 9*a* that has remained on the intermediate transfer belt 47. The fixing device 49 fixes the toner image to the sheet by heating.

[Outline of Developing Device 43]

Figure 2:
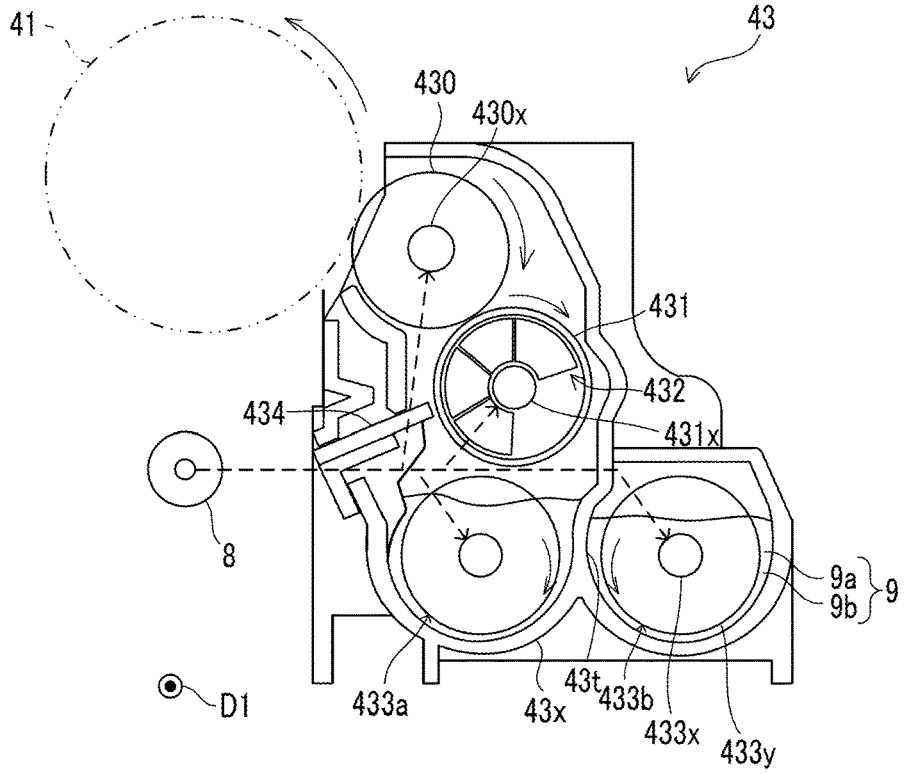
FIG. 2 is a configuration diagram of a developing device included in the image forming apparatus according to the embodiment.

As shown in FIG. 2, in the developing device 43, a developing tank 43*x* stores the toner 9*a* and the carrier 9*b*, wherein a developing roller 430, a magnetic roller 431, and a pair of conveyance members 433*a* and 433*b* rotate in the developing tank 43*x*. The developing roller 430, the magnetic roller 431, and the pair of conveyance members 433*a* and 433*b* are driven by an image generation motor 8 provided in the main body portion 1.

The image generation motor 8 drives rotators of the image generating unit 4. That is, the rotators driven by the image generation motor 8 include the photoconductor 41, as well as the developing roller 430 and the magnetic roller 431 of the developing device 43.

In addition, a blade 434 is disposed to face the magnetic roller 431. The developing device 43 executes the developing process by a so-called interactive touchdown method.

The developing tank 43*x*, the developing roller 430, the magnetic roller 431, the pair of conveyance members 433*a* and 433*b*, and the blade 434 are arranged such that the longitudinal directions thereof extend along the depth direction D1-D2 of the main body portion 1. The carrier 9*b* is stored in the developing tank 43*x* in advance, and the toner 9*a* is replenished from the toner replenishing unit 5 as necessary.

Figure 7:
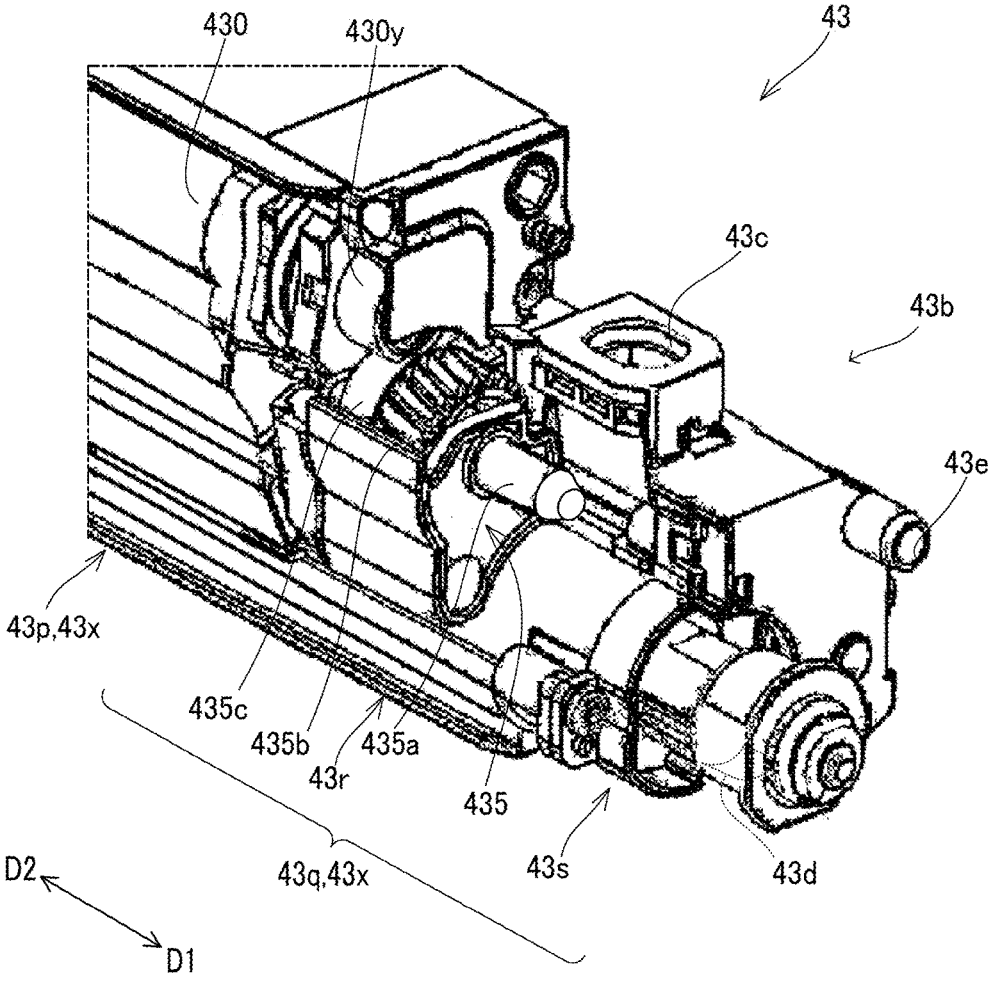
FIG. 7 is a perspective view of a rear end portion of the developing device included in the image forming apparatus according to the embodiment.
Figure 8:
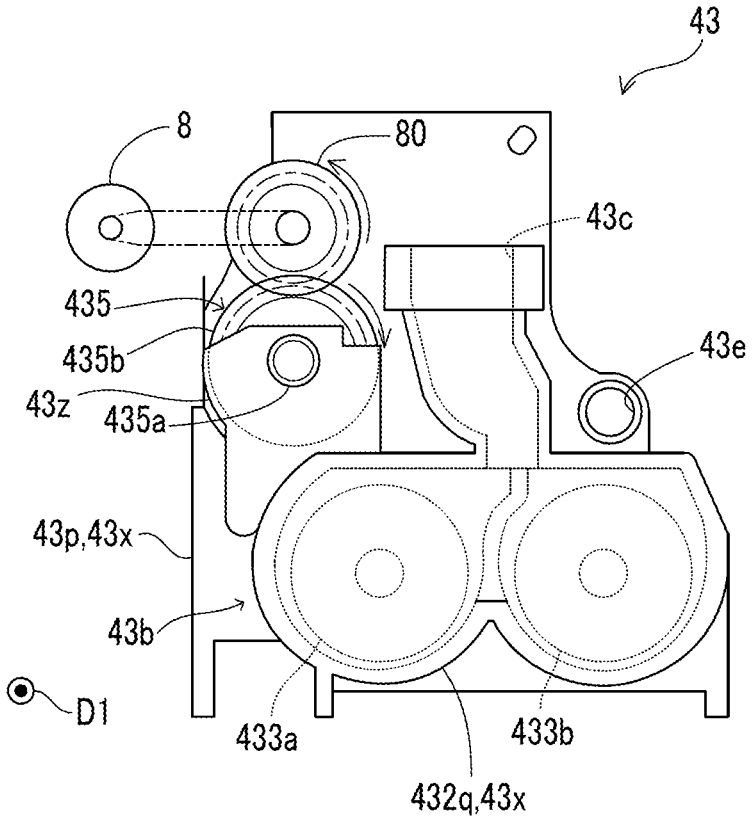
FIG. 8 is a rear view of the developing device included in the image forming apparatus according to the embodiment.
Figure 9:
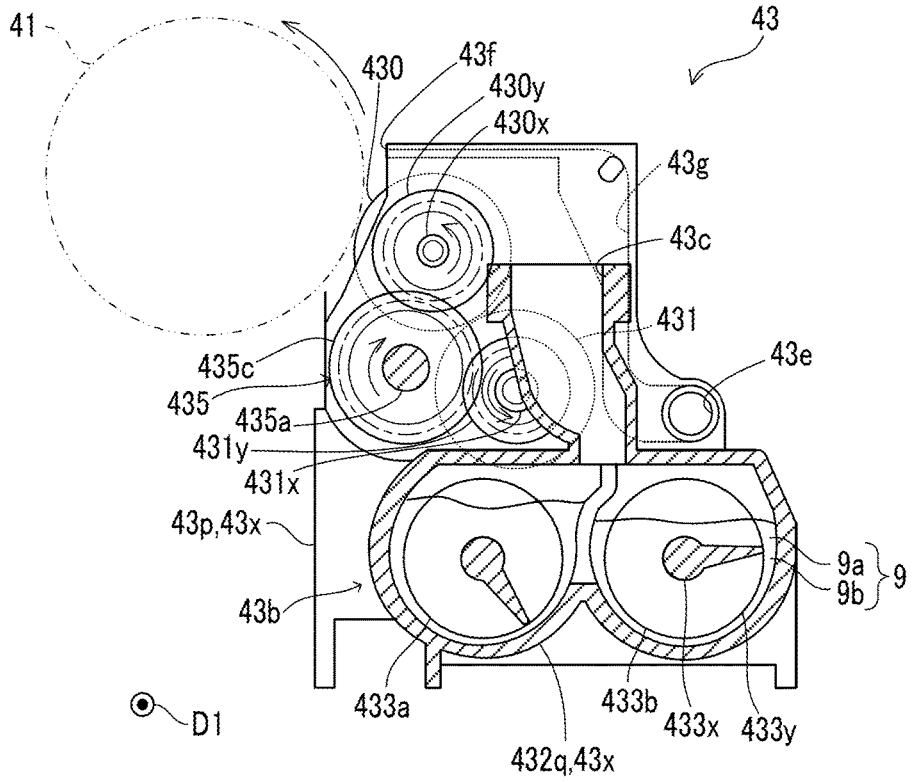
FIG. 9 is a cross-sectional view of the rear end portion of the developing device included in the image forming apparatus according to the embodiment.

As shown in FIG. 7 to FIG. 9, a receiving port 43*c* is formed in the developing tank 43*x*, wherein the toner 9*a* fed from the toner replenishing unit 5 is received through the receiving port 43*c*.

The magnetic roller 431 having a magnet 432 in its inside rotates while carrying the toner 9*a* and the carrier 9*b*. This allows a magnetic brush to be formed on the surface of the magnetic roller 431. The blade 434 restricts the height of the magnetic brush formed on the surface of the magnetic roller 431, namely, the thickness of the two-component developer 9 carried by the magnetic roller 431. Furthermore, the magnetic roller 431 supplies the toner 9*a* to the developing roller 430.

The developing roller 430 rotates while carrying the toner 9*a* supplied from the magnetic roller 431, and supplies the toner 9*a* to the surface of the photoconductor 41. This allows the electrostatic latent image on the surface of the photoconductor 41 to be developed as the toner image. It is noted that the magnetic roller 431 is an example of the developer carrying member that rotates while carrying the developer in the developing tank 43*x*.

Each of the pair of conveyance members 433*a* and 433*b* is a screw conveyer composed of a shaft core portion 433*x* and a spiral blade 433*y*, wherein the shaft core portion 433*x* is rotatably supported, and the spiral blade 433*y* spirally projects from the shaft core portion 433*x*. The shaft core portion 433*x* is supported to extend along the depth direction D1-D2 of the main body portion 1.

As shown in FIG. 2 and FIG. 9, the pair of conveyance members 433*a* and 433*b* are arranged in parallel to each other in the developing tank 43*x* below the magnetic roller 431 to extend along the longitudinal direction of the developing tank 43*x*, namely, the depth direction D1-D2 of the main body portion 1. The pair of conveyance members 433*a* and 433*b* rotate in conjunction with the developing roller 430 and the magnetic roller 431 so as to cyclically convey the two-component developer 9 in the developing tank 43*x*.

As shown in FIGS. 2 and 9, a partition wall 43*t* is formed between intermediate regions of the pair of conveyance members 433*a* and 433*b* to extend along the longitudinal direction thereof, the intermediate regions excluding end regions thereof at opposite ends in the longitudinal direction. The developing tank 43*x* and the partition wall 43*t* form a circulation path of the two-component developer 9 that reciprocates along the longitudinal direction of the developing tank 43*x*, namely, the depth direction D1-D2 of the main body portion 1.

The toner 9*a* that has been removed from the photoconductor 41 and the intermediate transfer belt 47 by the primary cleaning device 45 and the secondary cleaning device 470 is conveyed to the developer collecting unit 6, and collected in the developer collecting unit 6.

Furthermore, a part of the toner 9*a* and the carrier 9*b* that have been deteriorated in the developing tank 43*x*, and the toner 9*a* that flows between the developing roller 430 and the photoconductor 41 are collected in the developer collecting unit 6, as well. That is, the developer collecting unit 6 stores waste developer 90 that is composed of waste toner 90*a* and waste carrier 90*b*, wherein the waste toner 90*a* is used toner 9*a*, and the waste carrier 90*b* is used carrier 9*b*.

Figure 10:
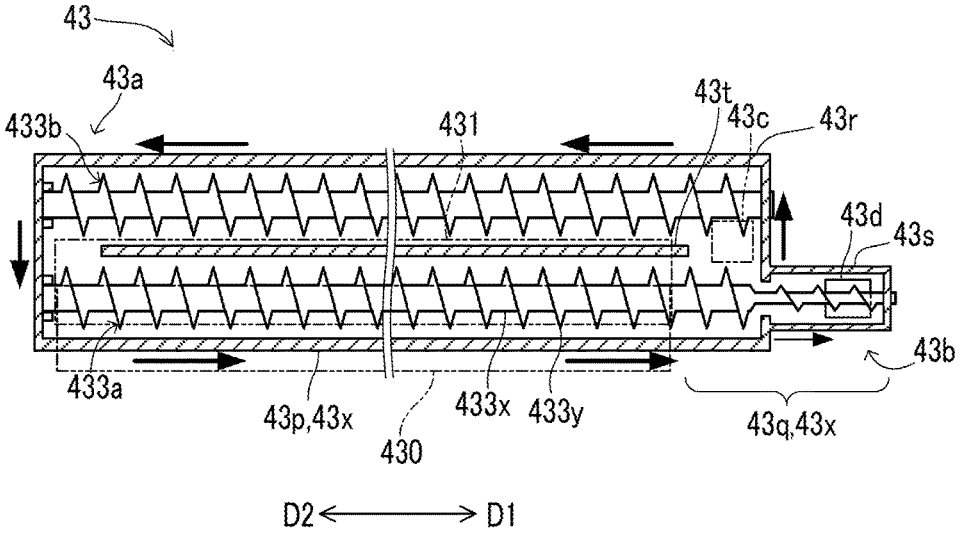
FIG. 10 is a plan cross-sectional view of the developing device included in the image forming apparatus according to the embodiment.

As shown in FIG. 7 and FIG. 10, a discharge port 43*d* and an air exhaust port 43*e* are formed in the developing tank 43*x*, wherein the discharge port 43*d* is an opening through which a part of the toner 9*a* and the carrier 9*b* cyclically conveyed by the pair of conveyance members 433*a* and 433*b* is discharged, and the air exhaust port 43*e* is an opening through which the flowing toner 9*a* is discharged. The toner 9*a* flowing between the developing roller 430 and the photoconductor 41 is collected by being passed through an air filter (not shown) together with air by a suction fan (not shown).

The developer collecting unit 6 is attached to a collecting unit attachment portion 60 provided in the main body portion 1 in a detachable manner. A replacement of the developer collecting unit 6 is performed when the waste developer 90 stored therein has exceeded a predetermined acceptable amount. Details of the developer collecting unit 6 are described below.

In the image forming apparatus 10, the image generation motor 8 and a drive input portion 435 of the developing device 43 are provided on a rear side in the main body portion 1 so as to suppress transmission of the machinery sounds to a user side, namely a front side of the main body portion 1 (see FIG. 7, FIG. 8). The drive input portion 435 receives a rotational force from the image generation motor 8, and transmits the received rotational force to rotation shafts of the rotators such as the magnetic roller 431.

Meanwhile surroundings of the receiving port 43*c* and the discharge port 43*d* of the developing tank 43*x* of the developing device 43 are likely to be smeared by the toner 9*a* that leaks during replacement of the toner replenishing unit 5 or the developer collecting unit 6, wherein the toner 9*a* is received through the receiving port 43*c* and the waste developer 90 is discharged through the discharge port 43*d*.

Accordingly, when the receiving port and the discharge port of the developing tank 43*x* are formed in a front end portion of the main body portion 1 in the developing device 43, the toner 9*a* that leaks during replacement of the toner replenishing unit 5 or the developer collecting unit 6 may be scattered outside the device and smear the hands and clothes of the user.

The image forming apparatus 10 has a structure that can suppress transmission of the machinery sounds to the front side of the main body portion 1, while preventing the toner 9*a* from being scattered or smearing the hands and the like of the user when replacement of the toner replenishing unit 5 or the developer collecting unit 6 is performed. The structure is described in the following.

[Toner Replenishing Units 5]

Figure 3:
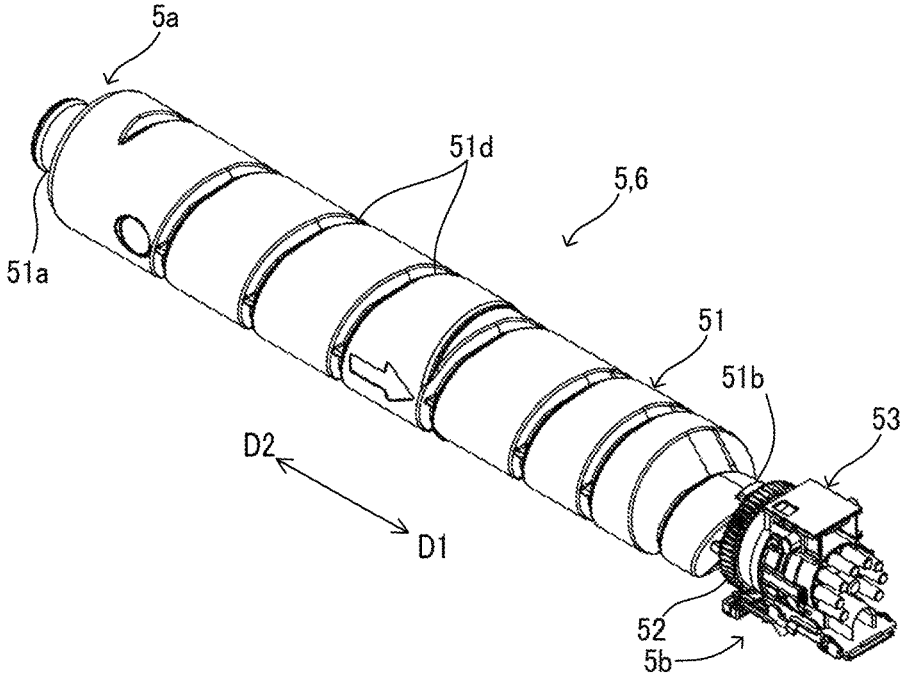
FIG. 3 is a perspective view of a toner replenishing unit included in the image forming apparatus according to the embodiment.
Figure 4:
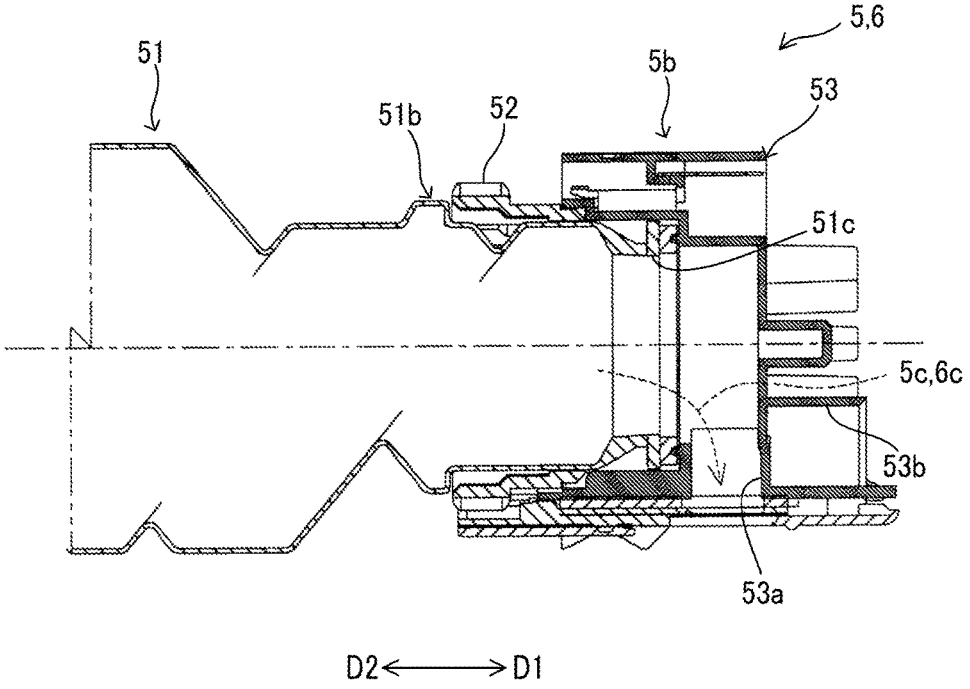
FIG. 4 is a cross-sectional view of an end portion of the toner replenishing unit included in the image forming apparatus according to the embodiment.

As shown in FIG. 3 and FIG. 4, each of the toner replenishing units 5 includes a storage portion 51, a gear 52, and a cover portion 53. The storage portion 51 is a hollow member capable of storing unused toner 9*a* that is supplied to the developing device 43. A first end portion 51*a* of the storage portion 51 is hermetically sealed, and an opening 51*c* is formed in a second end portion 51*b* of the storage portion 51.

A spiral projection portion 51*d* is formed, inside the storage portion 51, in a spiral shape along a longitudinal direction of the storage portion 51. It is noted that when viewed from outside the storage portion 51, the spiral projection portion 51*d* is a spiral recess portion.

The gear 52 is fixed to the second end portion 51*b* of the storage portion 51. The cover portion 53 has an opening 53*a* that communicates with the opening 51*c* of the storage portion 51, and rotatably supports the second end portion 51*b* of the storage portion 51. The cover portion 53 constitutes a second end portion 5*b* of the toner replenishing unit 5.

In the second end portion 5*b* of the toner replenishing unit 5, an opening that extends from the opening 51*c* of the storage portion 51 to the opening 53*a* of the cover portion 53 forms a feed port 5*c* that is communicated with the receiving port 43*c* of the developing tank 43*x*, wherein the toner 9*a* is fed through the feed port 5*c*.

When a replenishment motor (not shown) provided on the rear side in the main body portion 1 is activated, the rotational force of the replenishment motor is transmitted to the gear 52, and the storage portion 51 is integrally rotated with the gear 52. At this time, the storage portion 51 is rotated in such a direction that the spiral projection portion 51*d* conveys the toner 9*a* to the feed port 5*c*.

Figure 5:
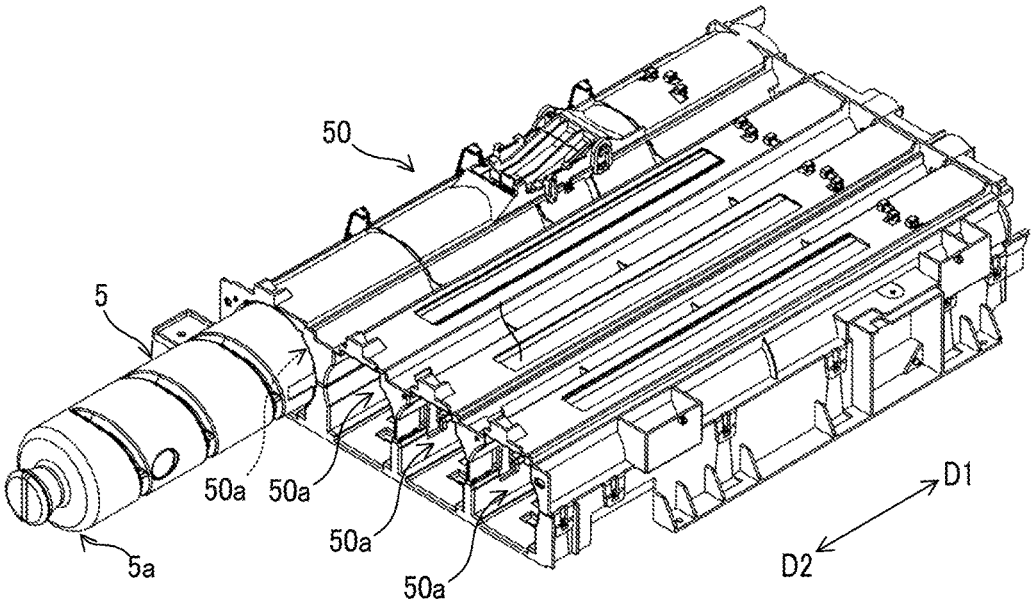
FIG. 5 is a perspective view of a replenishing unit attachment portion included in the image forming apparatus according to the embodiment.

The toner replenishing units 5 are attached to the replenishing unit attachment portion 50 of the main body portion 1 from the front side thereof in a detachable manner. As shown in FIG. 5, a hollow 50*a* is formed in the replenishing unit attachment portion 50 along the depth direction D1-D2.

When a toner replenishing unit 5 is attached to the replenishing unit attachment portion 50, the toner replenishing unit 5 is inserted into the hollow 50*a* from the front side of the main body portion 1 in the first direction D1, with the second end portion 5*b* thereof in the longitudinal direction being at the head. Here, the toner replenishing unit 5 is attached to the replenishing unit attachment portion 50 with an attitude where the feed port 5*c* faces downward.

In a state where the toner replenishing units 5 is attached to the replenishing unit attachment portion 50, the toner replenishing unit 5 extends along the depth direction D1-D2 of the main body portion 1. In that state, the first end portion 5*a* and the second end portion 5*b* of the toner replenishing unit 5 in the longitudinal direction are located close to the front surface and the rear surface of the main body portion 1, respectively.

When the toner replenishing unit 5 is detached from the replenishing unit attachment portion 50, the toner replenishing unit 5 is pulled out from the hollow 50*a* in the second direction D2, with a first end portion 5*a* thereof at an end in the longitudinal direction thereof being at the head.

[Developer Collecting Unit 6]

In the present embodiment, the toner replenishing unit 5 that has been used serves as the developer collecting unit 6. That is, the toner replenishing unit 5 can be used as the developer collecting unit 6, and in that case, the storage portion 51 stores the toner 9*a* and the carrier 9*b* that are discharged from the primary cleaning device 45, the secondary cleaning device 470, and the developing device 43.

In addition, when the toner replenishing unit 5 is used as the developer collecting unit 6, the feed port 5*c* of the toner replenishing unit 5 functions as a collection port 6*c* that is an opening which is communicated with the discharge port 43*d* of the developing tank 43*x* and through which the toner 9*a* and the carrier 9*b* are collected.

When a collecting motor (not shown) provided on the rear side in the main body portion 1 is activated, the rotational force of the collecting motor is transmitted to the gear 52, and the storage portion 51 is integrally rotated with the gear 52. At this time, the storage portion 51 is rotated in such a direction that the spiral projection portion 51*d* conveys the toner 9*a* and the carrier 9*b* from the collection port 6*c* to the first end portion 51*a* of the storage portion 51.

Figure 6:
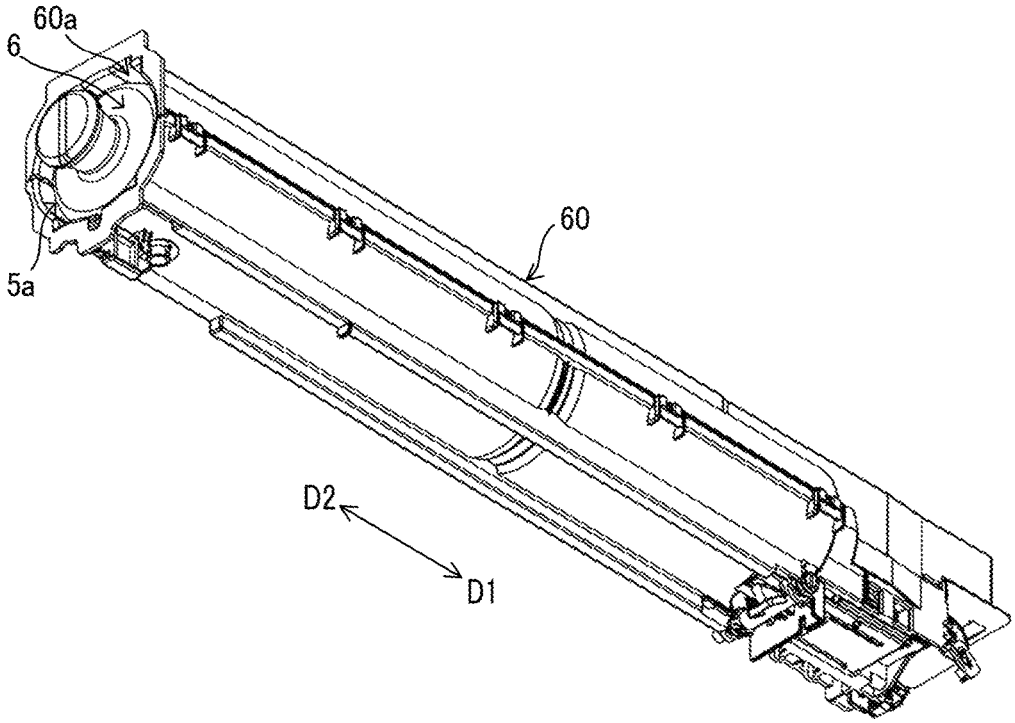
FIG. 6 is a perspective view of a collecting unit attachment portion included in the image forming apparatus according to the embodiment.

The developer collecting unit 6 is attached to the collecting unit attachment portion 60 of the main body portion 1 from the front side thereof in a detachable manner. As shown in FIG. 6, a hollow 60*a* is formed in the collecting unit attachment portion 60 along the depth direction D1-D2.

When the developer collecting unit 6 is attached to the collecting unit attachment portion 60, the developer collecting unit 6 is inserted into the hollow 60*a* from the front side of the main body portion 1 in the first direction D1, with the second end portion 5*b* thereof at an end in the longitudinal direction being at the head. Here, the developer collecting unit 6 is attached to the collecting unit attachment portion 60 with an attitude where the collection port 6*c* faces upward.

In a state where the developer collecting unit 6 is attached to the collecting unit attachment portion 60, the developer collecting unit 6 extends along the depth direction D1-D2 of the main body portion 1. In that state, the first end portion 5*a* and the second end portion 5*b* of the developer collecting unit 6 in the longitudinal direction are located close to the front surface and the rear surface of the main body portion 1, respectively.

When the developer collecting unit 6 is detached from the collecting unit attachment portion 60, the developer collecting unit 6 is pulled out from the hollow 60*a* in the second direction D2, with the first end portion 5*a* thereof at an end in the longitudinal direction being at the head.

[Details of Developing Device 43]

As described above, the developing device 43 includes the developing tank 43*x* and the drive input portion 435, wherein the receiving port 43*c*, the discharge port 43*d*, and the air exhaust port 43*e* are formed in the developing tank 43*x*, and the drive input portion 435 receives a rotational force from the image generation motor 8 disposed outside the developing device 43 and transmits the received rotational force to the magnetic roller 431. The image generation motor 8 is an example of the motor that is configured to generate the rotational force to be output to the drive input portion 435.

In the following description, an end portion of the developing tank 43*x* located close to the front surface in the depth direction D1-D2 is referred to as a first end portion 43*a*, and an end portion located close to the rear surface is referred to as a second end portion 43*b* (see FIG. 10).

As shown in FIG. 7, the receiving port 43*c*, the discharge port 43*d*, the air exhaust port 43*e*, and the drive input portion 435 are provided in the second end portion 43*b* of the developing tank 43*x* in the longitudinal direction thereof. Accordingly, when the developing device 43 is adopted, it is possible to avoid that the toner 9*a* that leaks during replacement of the toner replenishing unit 5 or the developer collecting unit 6, is scattered outside the device and smear the hands and clothes of the user.

As shown in FIG. 7 and FIG. 10, the developing tank 43*x* includes a base portion 43*p* and an extension portion 43*q*, wherein the base portion 43*p* and the extension portion 43*q* respectively constitute a part and another part of the longitudinal direction. The base portion 43*p* surrounds the developing roller 430, the magnetic roller 431, and a part of the pair of conveyance members 433*a* and 433*b* that is parallel to the magnetic roller 431.

On the other hand, the extension portion 43*q* surrounds another part of the pair of conveyance members 433*a* and 433*b* that projects along the longitudinal direction from the part of the pair of conveyance members 433*a* and 433*b* that is parallel to the magnetic roller 431. In the present embodiment, the extension portion 43*q* surrounds the other part of the pair of conveyance members 433*a* and 433*b* that projects toward the rear side of the main body portion 1, from the part of the pair of conveyance members 433*a* and 433*b* that is parallel to the magnetic roller 431.

As shown in FIG. 10, the pair of conveyance members 433*a* and 433*b* include a first conveyance member 433*a* and a second conveyance member 433*b*, wherein the first conveyance member 433*a* conveys the two-component developer 9 in the first direction D1, and the second conveyance member 433*b* conveys the two-component developer 9 in the second direction D2.

The first conveyance member 433*a* is disposed closer to the magnetic roller 431 than the second conveyance member 433*b*, and the toner 9*a* and the carrier 9*b* are drawn up from the first conveyance member 433*a* to the magnetic roller 431. The first conveyance member 433*a* is formed to extend longer toward the rear side of the main body portion 1 than the second conveyance member 433*b*.

As shown in FIG. 10, the extension portion 43*q* includes a first extension portion 43*r* and a second extension portion 43*s*. The first extension portion 43*r* surrounds a region in which the pair of conveyance members 433*a* and 433*b* are parallel to each other, and the second extension portion 43*s* surrounds only an extension part of the first conveyance member 433*a* that projects longer toward the rear side of the main body portion 1 than the second conveyance member 433*b*.

As shown in FIG. 7 and FIG. 10, the receiving port 43*c* is formed above a position located between the shaft core portions 433*x* of the pair of conveyance members 433*a* and 433*b* in the first extension portion 43*r*. It is noted that in FIG. 10, the receiving port 43*c* is represented by an imaginary line (two-dot chain line).

In addition, as show in FIG. 7 and FIG. 10, the discharge port 43*d* is formed below the second extension portion 43*s*. As a result, among the two-component developer 9 that is cyclically conveyed in the base portion 43*p* of the developing tank 43*x*, only minimal part climbs over a partition and enters the second extension portion 43*s*. The two-component developer 9 that has entered the second extension portion 43*s* is discharged from the discharge port 43*d* downward.

The toner 9*a* and the carrier 9*b* discharged from the discharge port 43*d* are conveyed along an intermediate conveyance path (not shown), and then are collected in the storage portion 51 of the developer collecting unit 6 via the collection port 6*c* of the developer collecting unit 6. The discharge port 43*d* of the developing tank 43*x* and the collection port 6*c* of the developer collecting unit 6 are communicated with each other via the intermediate conveyance path which is formed in the main body portion 1 to be close to the rear surface thereof.

In general, when the toner 9*a* drops on a shaft core portion 433*x* of one of the pair of conveyance members 433*a* and 433*b*, the toner 9*a* is difficult to mix from the upper layer to the lower layer of the existing two-component developer 9 in the developing tank 43*x*.

In the developing device 43, the toner 9*a* supplied to the developing tank 43*x* drops on a position between the shaft core portions 433*x* of the pair of conveyance members 433*a* and 433*b*. This makes it easy for the supplied toner 9*a* to mix from the upper layer to the lower layer of the existing two-component developer 9 in the developing tank 43*x*.

In addition, the supplied toner 9*a* drops on a position where the two-component developer 9 is in the middle of moving from the first conveyance member 433*a* side to the second conveyance member 433*b* side. Thus the supplied toner 9*a* is conveyed by the second conveyance member 433*b* from the second end portion 43*b* to the first end portion 43*a* of the developing tank 43*x* while being stirred and reaches the region where it is drawn up to the magnetic roller 431.

As a result, the supplied toner 9*a* is prevented from being drawn up to the magnetic roller 431 in an insufficiently charged state, and a generation of a development defect due to this is prevented.

In addition, as shown in FIG. 9, a ventilation duct 43*g* communicating an air inlet port 43*f* with the air exhaust port 43*e* is formed in the developing tank 43*x*, wherein the air inlet port 43*f* is an opening facing the photoconductor 41, and the air exhaust port 43*e* is an opening formed in the extension portion 43*q*.

Air that contains toner 9*a* flowing between the developing tank 43*x* and the photoconductor 41 passes through the ventilation duct 43*g*. The suction fan generates an airflow heading from the air inlet port 43*f* toward the air exhaust port 43*e*.

The air exhaust port 43*e* communicates with the collection port 6*c* of the developer collecting unit 6 via the intermediate conveyance path. The toner 9*a* discharged from the air exhaust port 43*e* is trapped by the air filter in the intermediate conveyance path and, and together with the toner 9*a* and the carrier 9*b* discharged from the discharge port 43*d*, the trapped toner 9*a* is collected in the storage portion 51 of the developer collecting unit 6 via the collection port 6*c* of the developer collecting unit 6.

As shown in FIG. 7 and FIG. 8, the drive input portion 435 includes an input rotation shaft 435*a*, an input gear 435*b* and an output gear 435*c*, wherein the input gear 435*b* and the output gear 435*c* are provided on the input rotation shaft 435*a*. The input rotation shaft 435*a* is rotatably supported by a bearing 43*z* that is provided on the extension portion 43*q* of the developing tank 43*x*.

In the following description, a rotation shaft of the developing roller 430 is referred to as a first driven rotation shaft 430*x*, and a rotation shaft of the magnetic roller 431 is referred to as a second driven rotation shaft 431*x*. As the first driven rotation shaft 430*x* rotates, the developing roller 430 rotates, and as the second driven rotation shaft 431*x* rotates, the magnetic roller 431 rotates.

The input gear 435*b* meshes with a drive gear 80 that is disposed in the main body portion 1 at a position close to the rear surface thereof (see FIG. 8). The drive gear 80 is directly coupled with the rotation shaft of the image generation motor 8, or coupled with the image generation motor 8 via a gear mechanism.

It is noted that the drive gear 80 is an example of the rotator that is external to the developing device 43. In addition, the input gear 435*b* is an example of the engaging portion that rotates by being engaged with the rotator that is external to the developing device 43.

The output gear 435*c* meshes with a first driven gear 30*y* and a second driven gear 31*y*, the first driven gear 30*y* being provided on the first driven rotation shaft 430*x*, the second driven gear 31*y* being provided on the second driven rotation shaft 431*x*. Accordingly, as the image generation motor 8 is activated and the drive gear 80 rotates, the input gear 435*b* and the output gear 435*c* rotate, and at the same time, the developing roller 430 and the magnetic roller 431 rotate.

As described above, upon receiving a rotational force from outside the developing device 43, the drive input portion 435 transmits the rotational force to the second driven rotation shaft 431*x* of the magnetic roller 431.

It is noted that in the first end portion 43*a* of the developing tank 43*x*, gears (not shown) respectively provided on the shaft core portions 433*x* of the first conveyance member 433*a* and the second conveyance member 433*b* mesh with a gear (not shown) provided on the second driven rotation shaft 431*x* of the magnetic roller 431. This allows the pair of conveyance members 433*a* and 433*b* to rotate in conjunction with the magnetic roller 431.

As shown in FIG. 9, the input rotation shaft 435*a* is rotatably supported at a position that is shifted with respect to the first driven rotation shaft 430*x* downward in an upper region of the extension portion 43*q*.

In addition, when viewed from the longitudinal direction of the developing tank 43*x*, the input rotation shaft 435*a* is rotatably supported at a position that is shifted with respect to the receiving port 43*c* and the second driven rotation shaft 431*x* in the horizontal direction in an upper region of the extension portion 43*q*. With this arrangement, it is possible to prevent the drive input portion 435 and a mechanism that transmits a power to the drive input portion 435, from interfering with the receiving port 43*c* and a member coupled with the receiving port 43*c*.

It is noted that in general, the second driven rotation shaft 431*x* is coupled, by a coupling portion, with a drive portion that is disposed on the extension thereof. In that case, the receiving port 43*c* interferes with the drive input portion 435, and thus the receiving port 43*c* cannot be provided above a position between the shaft core portions 433*x* of the pair of conveyance members 433*a* and 433*b*.

APPLICATION EXAMPLES

In the developing device 43 described above, the drive input portion 435 may include, instead of the input gear 435*b*, a coupling portion provided on the input rotation shaft 435*a*. The coupling portion is engaged with a counterpart coupling portion provided on a rotator that is supported on the extension line of the input rotation shaft 435*a*. The rotator on which the counterpart coupling portion is provided is driven by the image generation motor 8.

It is noted that the developing device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device to develop, with developer, an electrostatic latent image formed on an image carrying member, the developing device comprising:

a developing tank configured to store the developer and having a receiving port and a discharge port through which the developer is received and discharged respectively;

a developer carrying member configured to rotate in the developing tank while carrying the developer;

a drive input portion configured to receive a rotational force from outside the developing device and transmit the rotational force to a driven rotation shaft that is a rotation shaft of the developer carrying member, wherein the receiving port, the discharge port, and the drive input portion are provided in the developing tank to be close to an end of the developing tank in a longitudinal direction thereof; and a pair of conveyance members arranged in parallel to each other in the developing tank below the developer carrying member to extend along the longitudinal direction, each of the conveyance members including a shaft core portion and a spiral blade, the shaft core portion being rotatably supported, the spiral blade spirally projecting from the shaft core portion, the pair of conveyance members being longer than the developer carrying member and rotating in conjunction with the developer carrying member so as to cyclically convey the developer in the developing tank, wherein the developing tank includes:

a base portion constituting a part of the longitudinal direction and surrounding the developer carrying member and a part of the pair of conveyance members that is parallel to the developer carrying member; and an extension portion constituting another part of the longitudinal direction and surrounding another part of the pair of conveyance members that projects along the longitudinal direction from the part of the pair of conveyance members that is parallel to the developer carrying member, the receiving port is formed above a position located between the shaft core portions of the pair of conveyance members in the extension portion, and the drive input portion includes:

an input rotation shaft rotatably supported at a position that is, when viewed from the longitudinal direction, shifted with respect to the receiving port and the driven rotation shaft in a horizontal direction in an upper region of the extension portion;

an engaging portion provided on the input rotation shaft and configured to rotate by being engaged with an external rotator; and an output gear provided on the input rotation shaft and configured to mesh with a gear provided on the driven rotation shaft.

2. The developing device according to claim 1, wherein a ventilation duct which communicates an air inlet port with an air exhaust port and through which air that contains flowing developer passes, is formed in the developing tank, the air inlet port being an opening facing the image carrying member, the air exhaust port being an opening formed in the extension portion.

3. An image forming apparatus comprising:

an image carrying member on whose surface an electrostatic latent image is formed;

the developing device according to claim 1 configured to develop the electrostatic latent image with developer;

a developer replenishing unit attached to an apparatus main body from a front side thereof in a detachable manner, the developer replenishing unit being formed to extend along a depth direction of the apparatus main body and storing developer to be replenished to the developing device, wherein an opening that is communicated with the receiving port of the developing tank is formed, as a feed port through which the developer is fed, in an end portion of the developer replenishing unit that is inserted to be on a rear side of the apparatus main body;

a developer collecting unit attached to the apparatus main body from the front side thereof in a detachable manner, the developer collecting unit being formed to extend along the depth direction of the apparatus main body and storing developer discharged from the developing device, wherein an opening that is communicated with the discharge port of the developing tank is formed, as a collection port through which the developer is collected, in an end portion of the developer collecting unit that is inserted to be on the rear side of the apparatus main body; and a motor provided on the rear side in the apparatus main body and configured to generate the rotational force to be output to the drive input portion of the developing device.

* * * * *